United States Patent [19]

Farley, Jr. et al.

[11] Patent Number: 4,603,828

[45] Date of Patent: Aug. 5, 1986

[54] KINDER BAR AND KINDER GROW

[76] Inventors: Owen E. Farley, Jr., 29 Continental Dr., Centereach, N.Y. 11720; Gerard T. Hopkins, 24 Heritage La., Natick, Mass. 01760

[21] Appl. No.: 715,840

[22] Filed: Mar. 25, 1985

[51] Int. Cl.[4] ..... F16M 13/00

[52] U.S. Cl. ..... 248/542; 248/103; 248/251; 211/123; 33/169 R

[58] Field of Search ..... 248/542, 103, 102, 231.7, 248/251; 33/169 R; 446/227; 5/508; 211/105.1, 123

[56] References Cited

U.S. PATENT DOCUMENTS

| | | | |
|---|---|---|---|
| 771,768 | 10/1904 | Daugairtai | 446/227 X |
| 1,187,845 | 6/1916 | Kolb | 248/102 |
| 2,470,379 | 5/1949 | Swaim | 248/102 |
| 2,529,173 | 11/1950 | Moyer et al. | 248/102 X |
| 2,606,667 | 8/1952 | Hornick | 248/251 X |
| 3,009,580 | 11/1961 | Marr, Sr. | 211/105.1 |
| 3,633,862 | 1/1972 | Breen | 248/251 |
| 3,672,061 | 6/1972 | Alessi | 33/169 R |
| 3,987,904 | 10/1976 | Height et al. | 211/105.1 |

*Primary Examiner*—Ramon S. Britts
*Assistant Examiner*—Blair Johnson
*Attorney, Agent, or Firm*—Leonard Belkin

[57] ABSTRACT

A multi-use toy holder and exercise bar for a playpen and the like comprising a rigid rod supported by a bracket at each end, each bracket consisting of a main body with an opening for the bar and a U-shaped portion for mounting on a side rail of the playpen. Screw members are employed to lock the rod and brackets in place. The brackets are provided with tabs so that the unit can later be mounted in a closet to carry clothes hangers. Extra attachments are provided to make the device useful to track the growth in height of the youngster.

4 Claims, 12 Drawing Figures

FIG. 6
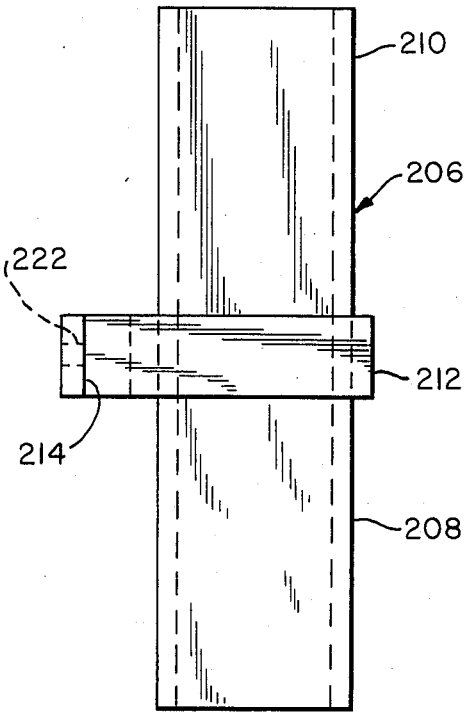
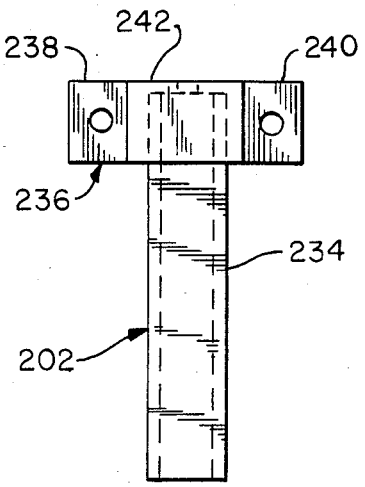
FIG. 8
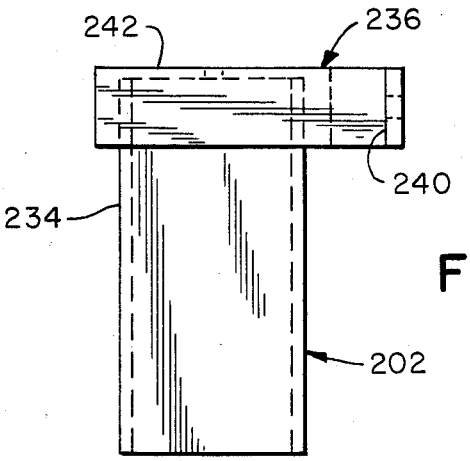
FIG. 9
FIG. 10
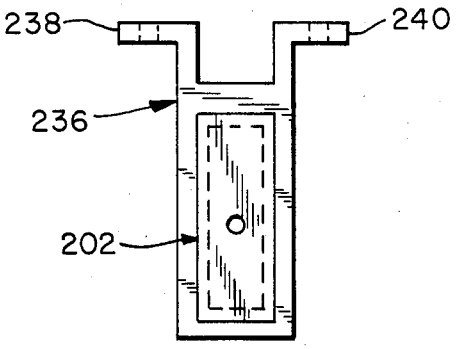
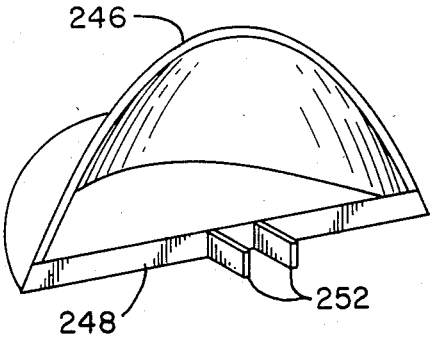
FIG. 11

KINDER BAR AND KINDER GROW

BACKGROUND OF THE INVENTION

This invention relates to a multi-use toy holder and exercise bar for use with playpens and the like.

At the present time there is no product available for use with playpens incorporating adequate safety features capable of acting as an exercise bar to which a variety of crib toys can be attached and is useful after the infant has outgrown the playpen.

In U.S. Pat. No. 1,187,845 to Kolb there is shown a holder for nursing bottles consisting of a bar extending from a head rail to a foot rail of a bed. The mounting brackets for the bar are relatively insecure for use with a toddler who is active and lacks any multi-use capability.

Canadian patent No. 476,968 to Dallaire (in French) shows a bar for apparent use with a crib and possibly a playpen having provision for supporting a nursing bottle. Here also the support arrangement is inadequate for use with an active child and lacks any multi-use capability once the child outgrows the playpen. German patent No. 116185 shows an elaborate holder having features which are believed to be unacceptable in today's environment where safety is considered of utmost importance.

U.S. Pat. Nos. 2,369,988 to Steckler and 3,071,253 show height measuring and clothes supporting devices, respectively, but neither of these patented devices is capable of being used in a playpen.

SUMMARY OF THE PRESNT INVENTION

The present invention consists of a multi-use bar capable of being used with any of the modern playpens now popular including those with netted side walls having adequate strength for use as an exercise bar for an active, growing child and to support a variety of toys which are useful in such toddler restraining devices. In addition, the invention incorporates features which render it useful for years even after the child outlives the playpen so that the inventive device need not be discarded or merely stored once the playpen is no longer being used.

In accordance with a preferred embodiment of this invention, there is provided a multi-use toy holder and exercise bar for use with a playpen and the like having spaced side rails comprising a rod member supported by a side rail bracket at each end. Each bracket consists of a main body with an opening therethrough to accommodate the end of the rod member and provision for a first screw to lock the rod member against movement. Extending from the main body of the bracket is a U-shaped portion to overlap the side rail and having another screw passing through one leg of the U-shaped portion to engage and lock the apparatus against the side rail to prevent movement. The latter screw is located on the side of the bracket away from the other side rail to limit access by the child and also for more convenient use by the attending adult. Each bracket is also provided with a pair of tabs flush with the side facing the opposite side rail so that the apparatus can be conveniently converted for use as a hanger for clothes in a closet or other enclosed space.

In addition, the apparatus may be provided with separate attachments to render the apparatus useful if desired as a height measuring gauge for the child. In this arrangement, three bracket members are utilized with the rod member to support the latter vertically adjacent a wall for use in indicating the height and tracking the growth of the child.

It is thus, a principal object of this invention to provide toy holder and exercise bar apparatus for a playpen and the like having improved safety and functional characteristics as well as being useful once said apparatus is no longer being used in a playpen.

Other objects and advantages of this invention will hereinafter become obvious from the following description of preferred embodiments of this invention.

BRIEF DESCRIPTION OF THE DRAWINGS

FIG. 6 is a side view of the bracket shown in FIG. 5.

FIG. 8 is a front elevation view of the top bracket employed in FIG. 4.

FIG. 9 is a side view of the bracket shown in FIG. 8.

FIG. 10 is a top view of the bracket show0 in FIG. 8.

FIG. 11 is a rear view of the height measuring device shown in FIG. 4.

DETAILED DESCRIPTION OF THE PREFERRED EMBODIMENTS

Figure 1:
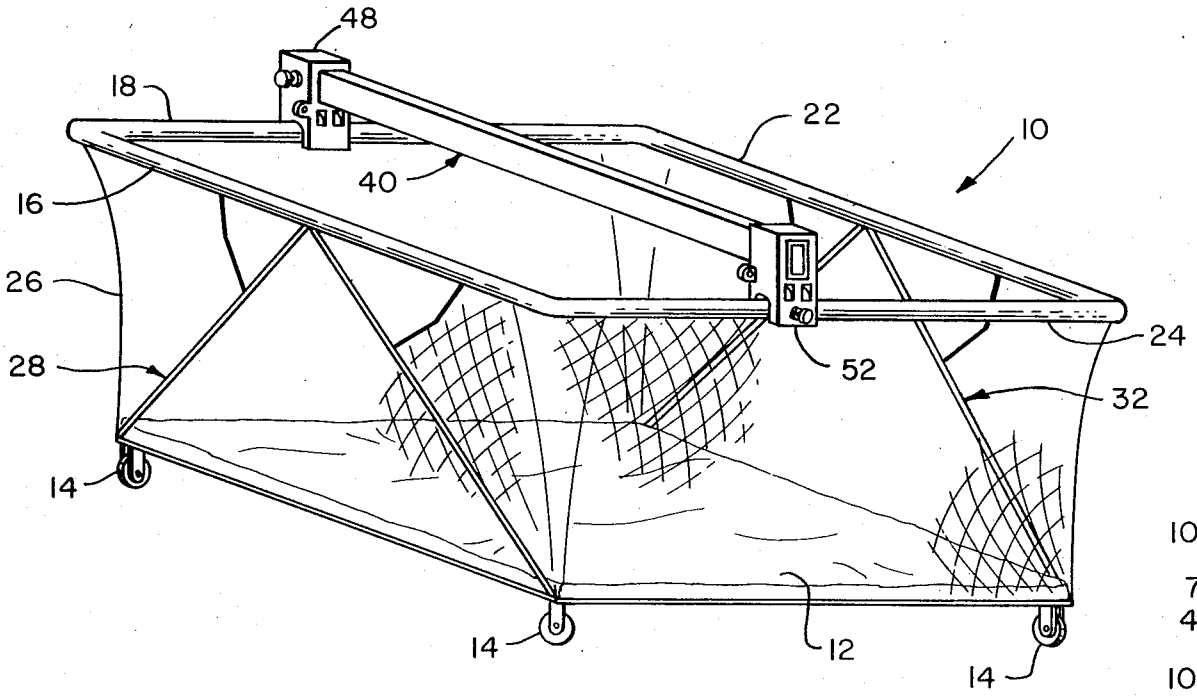
FIG. 1 is a partially schematic, isometric view of a playpen with a preferred embodiment of this invention mounted thereon.

Referring to FIG. 1, there is shown a playpen 10 of a design currently in vogue which consists of a foldable platform 12 supported on casters 14 and having collapsible side rails 16, 18, 22 and 24. A netting 26 encloses playpen 10 while mechanisms 28 and 32 are provided to collapse and open playpen 10. Playpen 10 is of conventional design and its construction forms no part of this invention, and playpens with other types of designs having side rails may be employed for use with this invention.

Mounted on side rails 18 and 24 is toy holder and exercise bar 40. For details of the latter, reference is made to FIG. 2 wherein it is seen that unit 40 consists of a rigid, hollow bar 42 supported on the ends thereof by a pair of side rail brackets 48 and 52. The latter are identical to each other.

Bracket 48 is of one piece construction consisting of a main body 54 with an opening 56 passing completely through to accommodate one end of member 42 and a U-shaped portion 58 with legs **58*a* and 58*b* extending downwardly to straddle side rail 18. A threaded opening 60 through outside leg 58*a* permits a threaded screw member 62 to be wound into the opening and engage side rail 18 and hence lock bracket 48 in place. It will be seen that screw member 62 has a large size handle 64** to permit convenient grasping and use without the need for any tools.

In order to clamp the end of member 42 within main body 52 of bracket 48, there is provided a raised platform 66 with a threaded opening 68 passing completely through into opening 56. A screw 72 identical in design to screw 62 is provided for locking member 42 in place. In addition, bracket 48 is provided with a pair of tabs 74 with openings 76. It will be seen that one surface of each of tabs 74 is flush with the inner surface of bracket 48, for a reason to be later described.

To reduce the cost and weight of brackets 48 and 52, it will be seen that bracket 48 has a hollowed out cavity 78 with ribs 82 for support.

As previously noted, bracket 52 is identical to bracket 48.

The ends of member 42 within brackets 48 and 52 may be provided with an end cap, such as cap 86. Cap 86 has a part 88 which enters and tightly fits the rectangular opening 89 within hollow member 46 and a lip 92 flush against the perimeter wall of member 46.

All of the structure of unit 40 as described above is made from any suitable light weight, rigid material such as a polymerized plastic, wood, aluminum, or any other metal alloy. The various elements making up the assembly are sufficiently large as to be impossible to swallow, and there are no sharp edges or corners, no spaces to trap a head, hands, fingers, or a foot. Hence, the unit is completely safe and lacks any risk of harm to the child, conforming to all applicable governmental regulations.

A device constructed in accordance with this invention mounted as shown and having suitable dimensions was found to support easily seventy-five pounds of weight, more than enough for any conceivable situation within a playpen or crib. Bar 42 can safely support any of the various crib and playpen toys which are available for use on crib rails.

Figure 3:
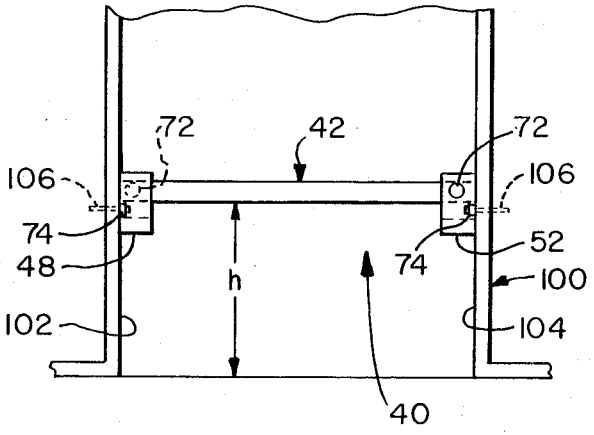
FIG. 3 is an elevation view of a closet showing another application of the preferred embodiment.

One of the advantages of toy holder and exercise bar 40 is its usefulness once it is no longer being used on a playpen or crib. As seen in FIG. 3, unit 40 may be disassembled and mounted within a closet 100 shown with the door removed. It will be seen that brackets 48 and 52 are reversed with tabs 74 flush against oppositely facing walls 102 and 104 at a height convenient to the size of the youngster. Bar 42 would be used to carry hangers for clothing. Screws 106 through tabs 74 would be employed to fix the brackets to the walls. Screw 72 in each bracket 48 and 52 is utilized to hold bar 42 in place. It should be noted that bar 40 could be of telescoping construction if desired to accommodate various closet widths, or be designed to permit convenient shortening.

Another application of this invention is illustrated in FIGS. 4–10.

Figure 4:
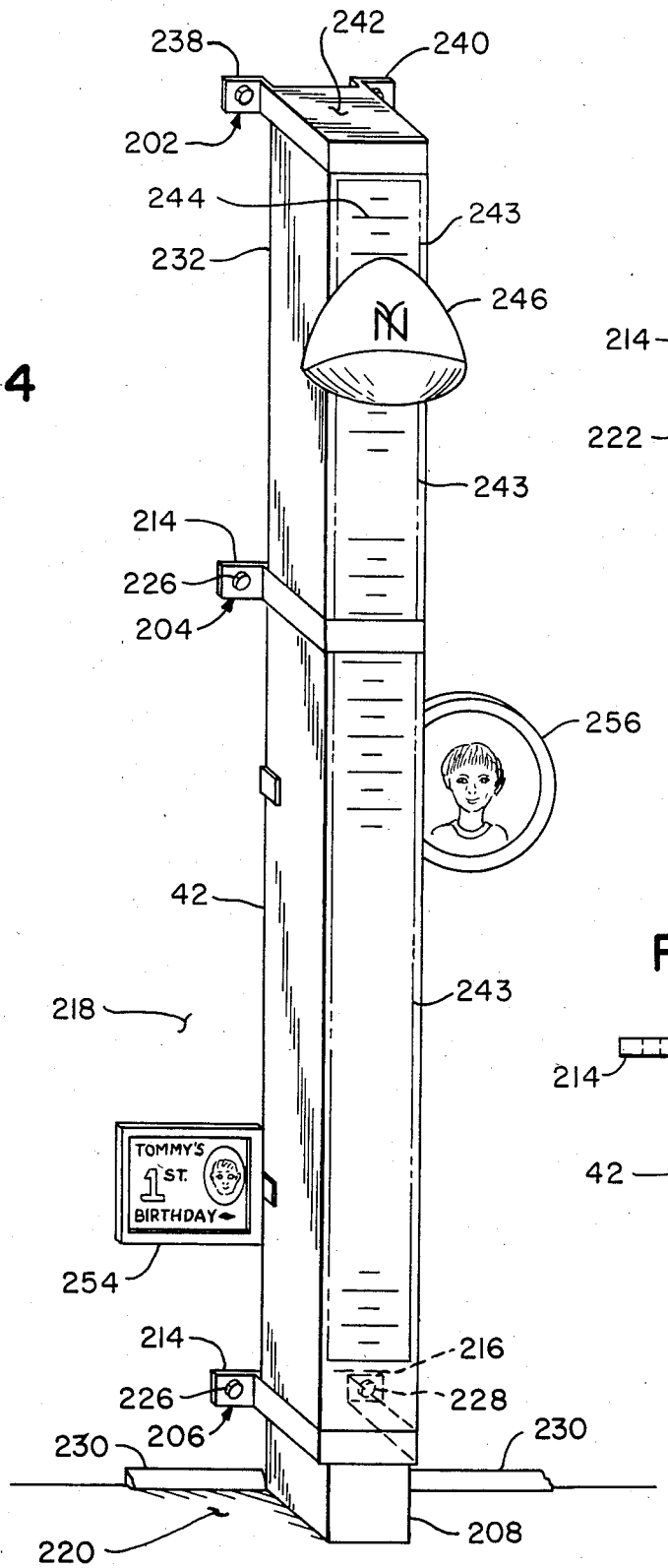
FIG. 4 is an isometric view of the preferred embodiment with additional attachments for measuring the height of the child.

Referring to FIG. 4 there is shown bar 42 in an upright position as part of an arrangement to measure and track the height of a child as he or she grows.

Figure 5:
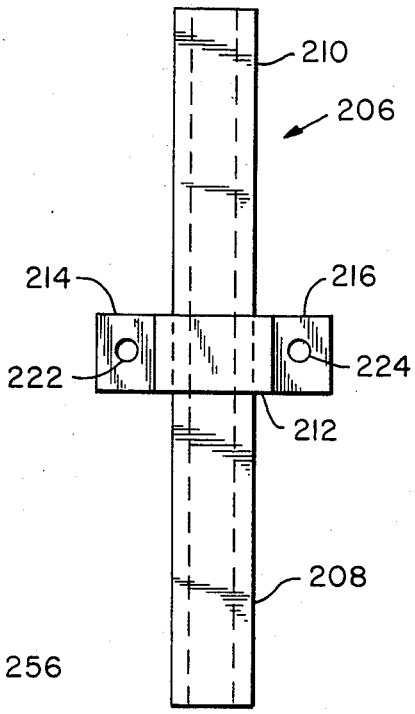
FIG. 5 is a front elevation view of a middle and bottom bracket employed in FIG. 4.
Figure 7:
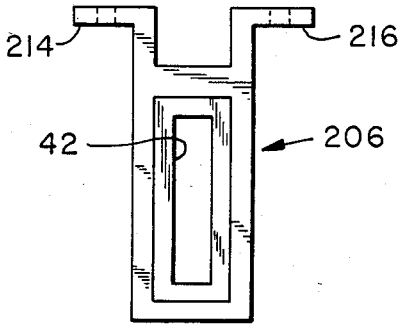
FIG. 7 is a top view of the bracket shown in FIG. 5.

Supporting bar 42 are brackets 202, 204 and 206. Brackets 204 and 206 are identical in construction and the details of bracket 206 are shown in FIGS. 5, 6, and 7. Bracket 206 is of integral construction with a lower extension 208, an upper extension 210, and a central attaching member 212 having tabs 214 and 216 for flush mounting against wall 218. Lower extension 208 of bracket 204 and upper extension 210 of bracket 206 fit into the hollow opening of rod 42 while lower extension 208 rests on floor 220. Tabs 214 and 216 are provided with openings 222 and 224 to accommodate screws 226 and 228 for attachment to wall 218. As seen in FIG. 7 tabs 214 and 216 are offset from extensions 208 and 210 so that the two latter and rod 42 are spaced from wall 218 to accommodate any molding 230 which typically may be used along the bottom of wall 218.

An upper hollow member 232 identical in cross section to that of member 42 is vertically arranged as illustrated in FIG. 4 with upper extension 210 of bracket 204 inserted within its hollow core. Top bracket 202, as seen in FIGS. 8, 9 and 10 is identical to brackets 204 and 206 except that it has only a lower extension 234 inserted within member 232, while its attaching member 236 with tabs 238 and 240 is closed and smooth on its upper surface 242.

It is thus seen that the assembly of FIG. 4 just described is a compact, smoothly arranged unit with no exposed edges firmly mounted on wall 218. Upper member 232 is provided with a decal 243 having graduations 244 which indicate height in inches from floor 220. A device 246 slidably mounted on upper member 232 would be positioned to contact the top of the head of the youngster to indicate the latter's height. As seen in FIG. 11 as well, device 246 is shaped in the form of a baseball cap with a retaining strip 248 supporting a pair of spring clips 252 to engage the front of upper member 232 for slidable movement up and down. In addition, there may be similarly provided a slidable plaque 254 to show a permanent record of the child's height at a certain birthday and still another slidable plaque 256 showing a photograph of the youngster. Plaques 254 and 256 have spring clips for attaching to the back of member 42.

All of the components of the apparatus described above would be marketed in the form of a kit to be assembled by the user. If desired, it can be sold as a basic kit consisting of member 42 with end brackets 48 and 52 to be used as illustrated in FIGS. 1 and 3, while the remaining components, namely, brackets 202, 204, and 206 along with upper member 232 may be sold in a separate kit to be added on when and if desired.

Figures 2, 12:
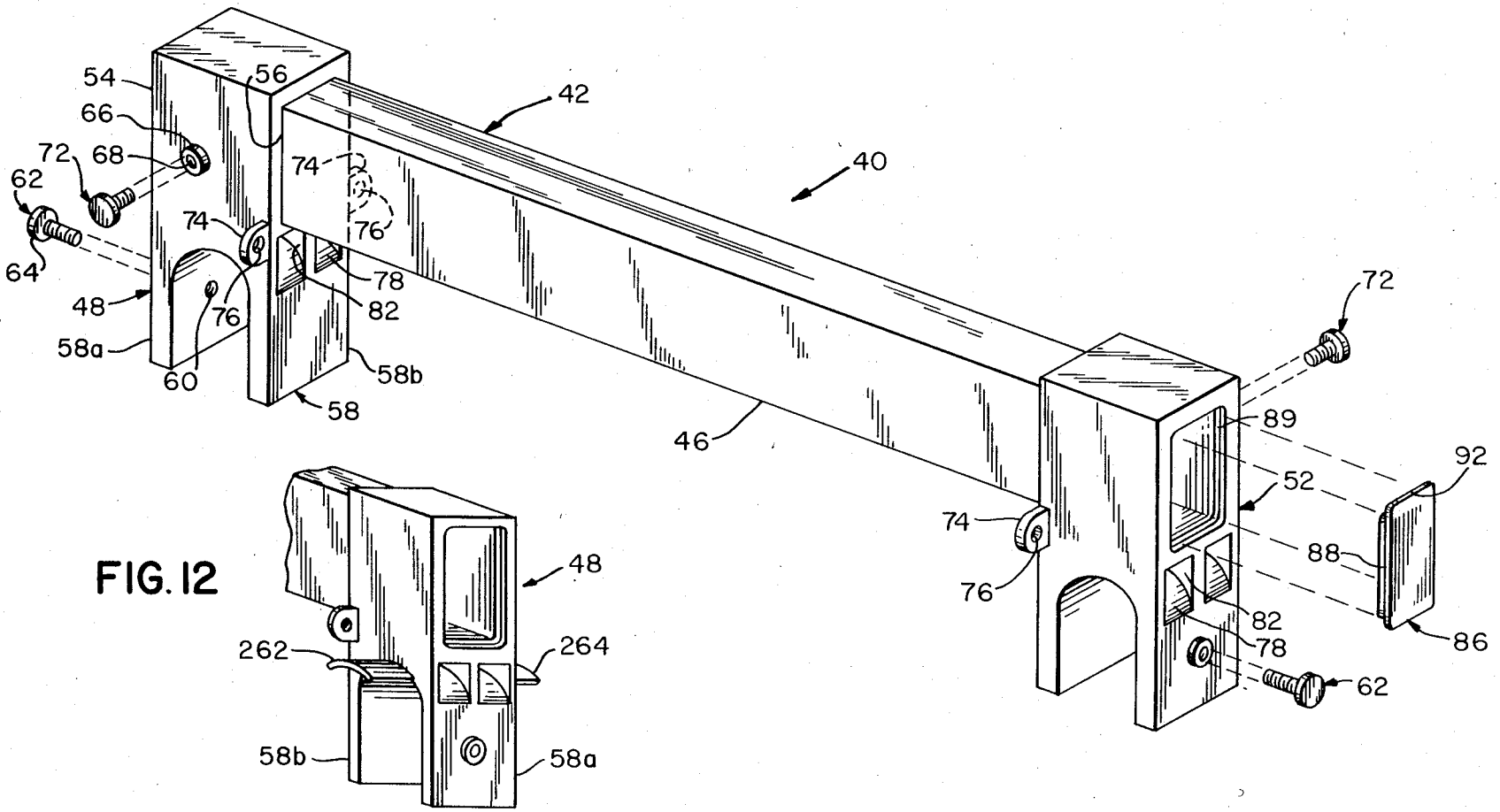
FIG. 2 is an isometric, partially exploded view of the preferred embodiment.
FIG. 12 is a modified design for the brackets.

In order to improve the stability of brackets 48 and 52 when mounted on side rails 18 and 24, a modified construction may be employed as shown in FIG. 12 illustrating bracket 48'. There it is seen that the bracket is provided with a pair of curved wing members 262 and 264 aligned underneath with upper surface formed by legs **58*a'* and 58*b'***.

It is thus seen there has been provided a uniquely functional, multi-use toy holder and exercise bar for use with playpens and the like incorporating features which make the device useful even when it is no longer needed on a playpen.

While only certain preferred embodiments of this invention have been described it is understood that many changes and additions are possible without departing from the principles of this invention as defined in the claims which follow.

What is claimed is:

1. Toy holder and exercise bar apparatus for use with playpen and the like having spaced side rails comprising a rod member of hollow, rectangular construction, a side rail bracket for each of the ends of said rod member for mounting on each of said spaced side rails, each said bracket consisting of a main body having an opening therethrough to accommodate one end of said rod member, means on said main body to accommodate a first screw member threaded therethrough to engage and lock said rod member against movement, a U-shaped portion extending from said main body to overlap one of said side rails for supporting said rod member on said side rail, means on said U-shaped portion to accommodate a second screw member threaded therethrough to engage the side rail so as to lock said apparatus against movement, said means to accommodate a second screw member being located on the side of said bracket away from the opposite side rail, and a pair of tab members mounted on opposite sides of each bracket flush with the side facing the opposite side rail with an opening through each of said tab members to accommodate a screw member, said side having a flat surface, thereby permitting said apparatus to be utilized within a closet or other compartment as a hanger for clothes and the like, each bracket being mounted on an oppositely facing wall, with the tabs and adjoining flat surface being flush against said wall supported by said screw members and said rod member supported at the ends thereof by each of said brackets.

2. The apparatus of claim 1 in which said rod member is rectangular in cross section and has a rectangular hollow opening therethrough.

3. The apparatus of claim 2 in which each of said brackets is provided with an end cap to close the opening for said rod member away from the latter.

4. The apparatus of claim 1 in which each of brackets includes means comprising wing member to stabilize the latter on said side rails.

* * * * *